US007003256B2

(12) United States Patent
Kumakura et al.

(10) Patent No.: US 7,003,256 B2
(45) Date of Patent: Feb. 21, 2006

(54) IMAGE RECORDING DEVICE

(75) Inventors: Shunichi Kumakura, Hachioji (JP); Masaki Kakutani, Hachioji (JP); Motoaki Aoyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/827,962

(22) Filed: Apr. 19, 2004

(65) Prior Publication Data

US 2005/0013640 A1 Jan. 20, 2005

(30) Foreign Application Priority Data

Jul. 16, 2003 (JP) ..... 2003-198011

(51) Int. Cl.
*G03G 21/00* (2006.01)

(52) U.S. Cl. ..... 399/366; 399/365

(58) Field of Classification Search ..... 399/365–376; 235/375, 380, 382, 454, 492, 494; 358/1.14–1.16
See application file for complete search history.

(56) References Cited

U.S. PATENT DOCUMENTS 6,827,279 B1 * 12/2004 Teraura ..... 235/492
2004/0035934 A1 * 2/2004 Miyazawa et al. ..... 235/454

FOREIGN PATENT DOCUMENTS

JP 2000-296653 A 10/2000
JP 2000285203 A * 10/2000
JP 2001229199 A * 8/2001
JP 2003141473 A * 5/2003

* cited by examiner

*Primary Examiner*—Minh Chau
(74) *Attorney, Agent, or Firm*—Frishauf, Holtz, Goodman & Chick, P.C.

(57) ABSTRACT

An image recording device includes: a reading unit for reading an image of original paper; a paper storage for storing recording paper of a plurality of types; a recording unit for recording the image read by the reading unit, on the recording paper alternatively selected from the paper storage; an original information receiving unit for receiving paper information from an information chip which is provided on the original paper and on which the paper information is stored; and a selection control unit for selecting the recording paper to be used for an image recording based on the paper information received by the original information receiving unit.

61 Claims, 9 Drawing Sheets

FIG.5A
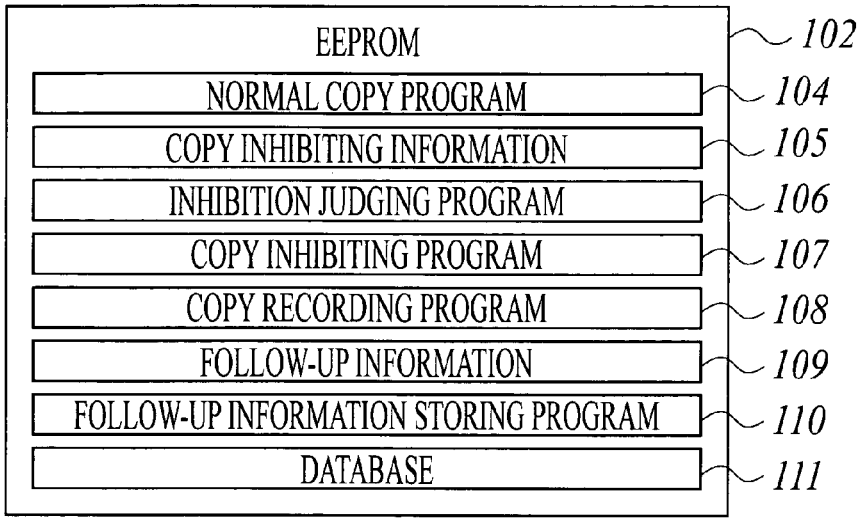
FIG.5B
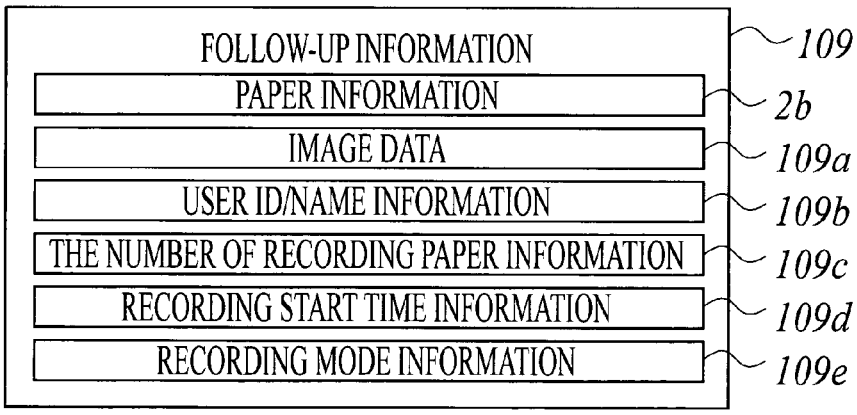
FIG.5C
| TRAY NUMBER | SIZE | 2b COLOR | TYPE |
|---|---|---|---|
| 1 | A4 | WHITE | RECYCLED PAPER |
| 2 | B4 | RED (COLORED PAPER) | PLAIN PAPER |
| 3 | A3 | WHITE | LETTERHEAD PAPER |

IMAGE RECORDING DEVICE

BACKGROUND OF THE INVENTION

1. Field of the Invention

The present invention relates to an image recording device for reading an image of original paper and recording the image on selected recording paper.

2. Description of Related Art

As the image recording device of above type, a copier or the like for reading an image of an original and recording the image on recording paper stored in a paper storage has been known (for example, refer to JP-Tokukai-2000-296653A). This image recording device comprises an IC reader for receiving paper information related to recording paper from a noncontact IC chip provided on the recording papery and a data transfer circuit for transferring the paper information to a control circuit.

In the IC chip, the type, the size, the color and the like of paper are stored as the paper information. Consequently, the paper information of the recording paper is recognized in a control unit of the image recording device. And then, the information of the recording paper set for the recording an image is checked out against the information of the recording paper actually stored. As the result of the check, when it is judged that the set recording paper differs from the stored recording paper, a display unit displays information accordingly to warn a user or the like, and the operation of the image recording is inhibited.

However, in the above image recording device, when the setting of the recording paper is not suitable for the recording of the image, the image recording is always suspended. That is, there is a problem that even if the image can be recorded on some recording paper stored in the paper storage other than the intended recording paper, the image recording can not be continued unless an operator or the like changes the setting so as to use other recording paper. That is, a user is finally required to perform the operation for changing the setting of the recording paper. Therefore, burdens of the user are not reduced sufficiently.

SUMMARY OF THE INVENTION

The present invention is in the view of above-mentioned problems. An object of the present invention is to provide an image recording device which can record an image on recording paper of another type on which the image can be recorded even when the setting of recording paper is unsuitable for the recording of the image of an original.

According to a first aspect of the present invention, an image recording device comprises:

a reading unit for reading an image of original paper;

a paper storage for storing recording paper of a plurality of types;

a recording unit for recording the image read by the reading unit, on the recording paper alternatively selected from the paper storage;

an original information receiving unit for receiving paper information from an information chip which is provided on the original paper and on which the paper information is stored; and a selection control unit for selecting the recording paper to be used for an image recording based on the paper information received by the original information receiving unit.

As above, when the image of the original is read by the reading unit, the paper information of the original paper is received by the original information receiving unit. Accordingly, the recording paper to be used for the image recording is automatically selected by the control unit. Consequently, based on the precise information, the proper recording paper corresponding to the image of the original is selected, and accordingly, the image recording can be performed appropriately.

Preferably, in the image recording device of the first aspect of the present invention, copy inhibiting information related to paper inhibited from copying is previously stored in a storage, and the image recording by the recording unit is inhibited, in a case that the original paper is paper inhibited from the copying, as a result of comparison between the paper information received by the original information receiving unit and the copy inhibiting information stored in the storage.

As above, in the case that the type of the original paper in the reading unit corresponds to the type of the copy inhibiting information stored in the storage, the image recording is inhibited. Consequently, it can be inhibited to copy the paper inhibited from copying by the law or the like, or the paper related to trade secrets.

Preferably, in the image recording device of the first aspect of the present invention, copy inhibiting information related to paper inhibited from copying is previously stored in a storage, and a predetermined image is recorded, being superposed on the image of the original, in a case that the original paper is paper inhibited from the copying, as a result of comparison between the paper information received by the original information receiving unit and the copy inhibiting information stored in the storage.

As above, in the case that the type of the original paper in the reading unit corresponds to the type of the copy inhibiting information stored in the storage, a predetermined image is recorded, being superposed on the image of the original. Consequently, it can be inhibited to entirely copy the paper inhibited from copying by the law or the like or the paper related to trade secrets.

Preferably, in the image recording device of the first aspect of the present invention, copy inhibiting information related to paper inhibited from copying is previously stored in a storage, and the image recording device further comprises an operating unit capable of selecting a mode alternatively between a copy inhibiting mode for inhibiting the image recording by the recording unit and a copy recording mode for controlling the recording unit so that a predetermined image is recorded, being superposed on the image of the original, in a case that the original paper is paper inhibited from the copying, as a result of comparison between the paper information received by the original information receiving unit and the copy inhibiting information stored in the storage.

As above, a user can select and operate a mode alternatively between the copy inhibiting mode and the copy recording mode by operating the operating unit 13. Then, in the copy inhibiting mode, when the type of the original paper in the reading unit corresponds to the type of the copy inhibiting information stored in the storage, the image recording is inhibited. Further, in the copy recording mode, when the type of the original paper in the reading unit corresponds to the type of the copy inhibiting information stored in the storage, a predetermined image is recorded, being superposed on the image of the original. Consequently, it is inhibited to copy the paper inhibited from copying by the law or the like, or the paper related to trade secrets. Further, it can be prevented to copy such paper entirely.

Preferably, in the image recording device of the first aspect of the present invention, the copy inhibiting information comprises information related to at least one of a bank note and marketable securities.

Consequently, by limiting the copying of at least one of banknotes and marketable securities, the forgery by such copying can be prevented.

Preferably, in the image recording device of the first aspect of the present invention, at least an image data of the original paper and the paper information of the original paper are stored in a storage as follow-up information, when the image recording is performed by the recording unit.

As above, when the image of the original is recorded on the recording paper, the follow-up information is stored in the storage. Consequently, a user can search the intended image data and intended paper information from the follow-up information stored in the storage.

Preferably, in the image recording device of the first aspect of the present invention, the follow-up information stored in the storage is outputted on the recording paper along with the image of the original when the image recording is performed by the recording unit.

Consequently, because the follow-up information stored in the storage is outputted to the recording paper, a user can recognize the follow-up information being stored in the storage.

Preferably, in the image recording device of the first aspect of the present invention, the original information receiving unit is placed in a scan head which is placed in the reading unit and moves along the original paper when the original is read.

As above, the scan head which moves along the original paper so as to scan whole image of the original paper is provided with the original information receiving unit. Therefore, no matter where on the original paper the information chip is provided, the paper information can be received certainly.

Preferably, in the image recording device of the first aspect of the present invention, further comprises a recording information receiving unit for receiving paper information from an information chip which is provided on the recording paper and on which the paper information is stored, wherein the control unit selects the recording paper to be used for the image recording based on the paper information received by the original information receiving unit and the paper information received by the recording information receiving unit.

As above, the recording paper to be used for the image recording is selected by using the paper information of the recording paper in addition to the paper information of the original paper. Therefore, based on more pieces of information, the proper recording paper corresponding to the image of the original is selected, and accordingly, the image recording can be performed more appropriately.

According to a second aspect of the present invention, an image recording device comprising:

a reading unit for reading an image of original paper;

a paper storage for storing recording paper of a plurality of types;

a recording unit for recording the image read by the reading unit, on the recording paper alternatively selected from the paper storage;

a recording information receiving unit for receiving paper information from an information chip which is provided on the recording paper and on which the paper information is stored; and a selection control unit for selecting the recording paper to be used for an image recording based on the paper information received by the recording information receiving unit.

As above, when the image of the original is read by the reading unit, the recording paper to be used for the image recording is automatically selected based on the paper information of the recording paper received by the recording information receiving unit. Consequently, based on the precise information, the proper recording paper 4 corresponding to the image of the original is selected, and accordingly, the image recording can be performed appropriately.

Preferably, in the image recording device of the first aspect and the second aspect of the present invention, the paper information received by the recording information receiving unit is stored in the storage.

Consequently, the selection of the recording paper can be performed by using the paper information stored in the storage. Therefore, it is not necessary that the paper information of the recording paper is recognized in real time. Further, also in the case that there is limitation that the reading of the paper information from the information chip can not be always performed because of the characteristics of the communication with the information chip, the proper recording paper can be selected based on recorded contents.

Preferably, the image recording device of the first aspect and the second aspect of the present invention, further comprises an information obtaining unit for obtaining information related to the recording paper in a state that the recording paper is stored, wherein when the paper information is not received by the recording information receiving unit, the information, which is obtained by the information obtaining unit and is related to the recording paper, is stored in the storage.

As above, when the paper information of the recording paper is not received, the information, which is obtained in the state that the recording paper is stored, is stored in the storage as the information of the recording paper. Consequently, even when the paper information can not be received because of the communication condition or the like in spite of the storing of the recording paper in the paper storage, the information of the recording paper is stored in the state that the recording paper is stored. Therefore, the selection of the recording paper can be performed.

Preferably, the image recording device of the first aspect and the second aspect of the present invention, further comprises an operating unit capable of operating selection of prior information for selecting recording paper to be used for the image recording, between the information obtained by the information obtaining unit and the information obtained by the recording information receiving unit.

Consequently, when the selection of the recording paper is performed, a user can operate the selection of the prior information between the information obtained by the information obtaining unit and the information obtained by the recording information receiving unit, by operating the operating unit. Therefore, for example, in the case that A4-sized recording paper, in which the information chip is implanted and which is provided by cutting A3-sized recording paper half artificially, is used, the recording paper can be selected precisely without mis-selecting the size thereof, by giving preference to the recording paper information obtained in the state that the recording paper is stored, over the information in information chip obtained from the recording paper information receiving unit.

Preferably, in the image recording device of the first aspect and the second aspect of the present invention, when the paper information is not received by the recording information receiving unit, it is displayed on a display unit that the information of the recording paper is not received.

As above, with the display unit, a user can recognize that the paper information of the recording paper is not received. Consequently, the user can perform procedures to obtain the paper information by inputting the paper information of the recording paper directly from the operating unit or the like of the device or by making the recording information receiving unit receive the paper information of the recording paper again.

Preferably, in the image recording device of the first aspect of the present invention, shielding members for shielding an electric wave are placed between a plurality of trays in the paper storage, in which the recording paper is stored.

As above, the trays are divided off each other by the shielding members. Therefore, there is no possibility that the electric waves from the information chips on the recording paper of the different types are received by the recording information receiving unit in the state that the electric waves are crossing each other, even when each of the recording paper of different types is respectively stored in each of the trays. That is, for example, in the case that the paper storage comprises the plurality of trays arrayed above and below each other, the paper information of the recording paper can be received appropriately with respect to each of the trays by placing the shielding members between the trays.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein:

FIG. 5A is an explanatory diagram of an EEPROM, FIG. 5B is an explanatory diagram of follow-up information, and FIG. 5C is an explanatory diagram of paper information;

PREFERRED EMBODIMENTS OF THE INVENTION

Hereinafter, the embodiment of the present invention will be described referring to FIG. 1 to FIG. 9. The following description is not intended as a definition of the limits of the scope of the art in the claim and the meanings of terms. Further, the following assertive description in the present embodiment shows the best mode and is not intended as a definition of the limits of the meanings of terms and the scope of the art of the present invention.

Figure 1:
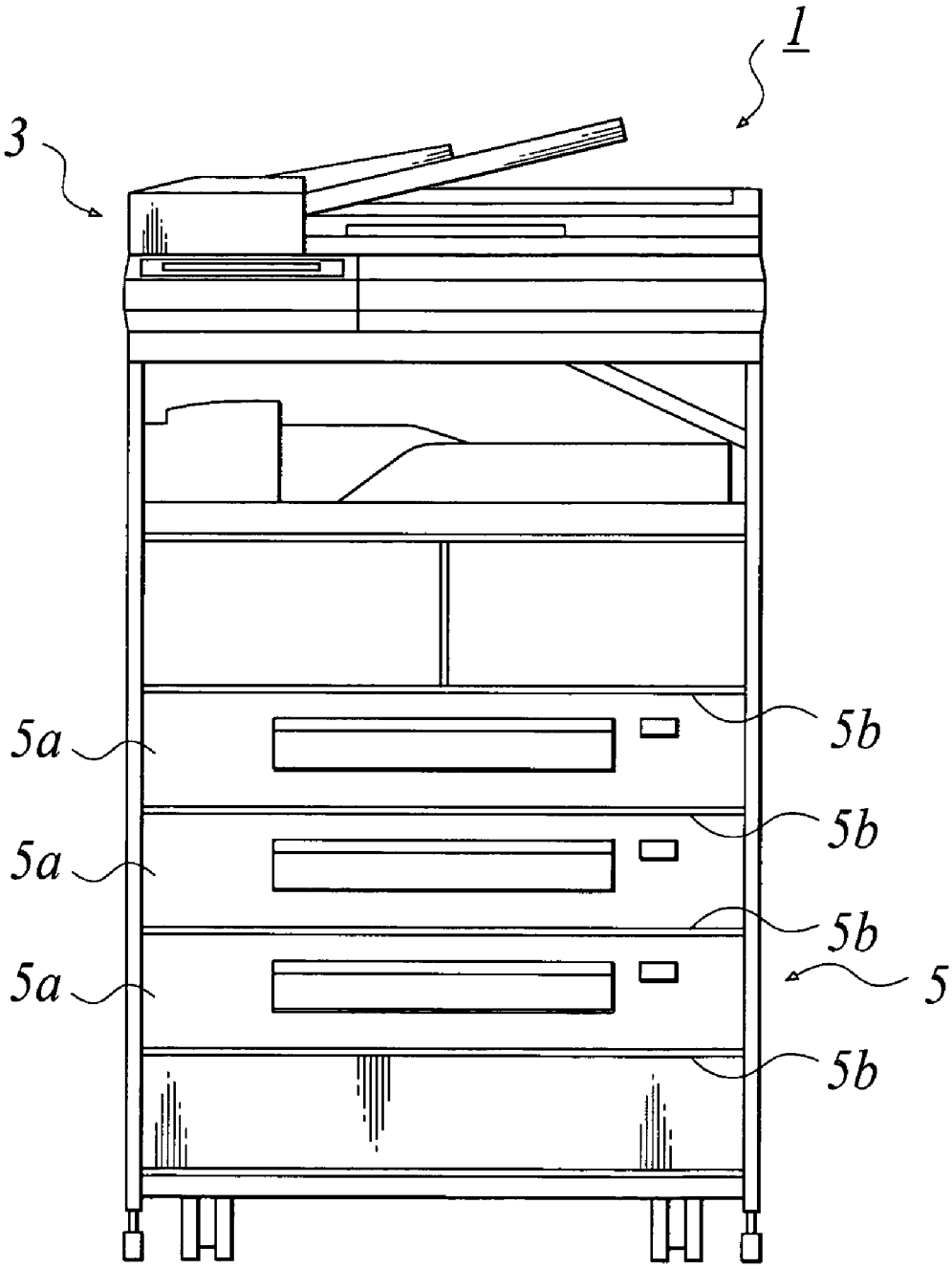
FIG. 1 is a schematic front view of a complex machine showing the first embodiment of the present invention.

As shown in FIG. 1, an image recording device exemplified in the present embodiment is a complex machine 1 having the functions of a copier (including a scanner), a printer, a facsimile or the like. In the upper portion of the complex machine 1, a reading unit 3 for reading an image of original paper 2 is provided. Further, in the lower portion of the complex machine 1, a paper storage 5 for storing recording paper 4 of a plurality of types is provided. The reading unit 3 comprises a movable scan head 3*a*. The reading unit 3 moves the scan head 3*a* along the original paper 2, and scans an image (refer to FIG. 2). The scan head 3*a* extends in a width direction of the device main body, and is movable in a longitudinal direction of the device main body. Further, the paper storage 5 comprises a plurality of trays 5*a* arrayed above and below each other. Each of the trays 5*a* can store the different recording paper 4 of different type, respectively. In the complex machine 1, the image read by the reading unit 3 is recorded on the recording paper 4, which is alternatively selected from the recording paper 4 of a plurality of types, by the recording unit 6. Incidentally, because the above configuration is the same as conventionally publicly known, detail description will not be provided here.

Figure 2:
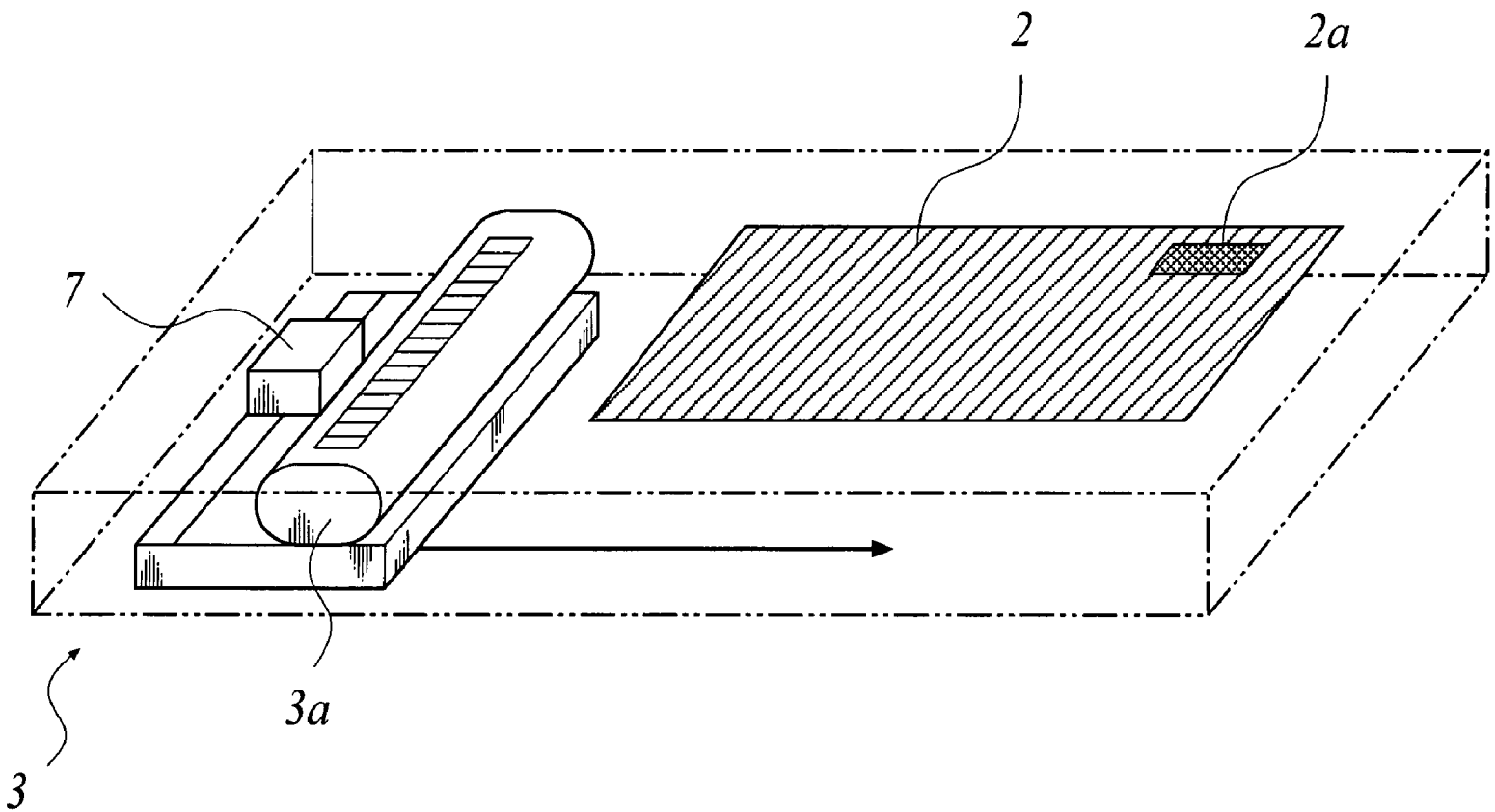
FIG. 2 is a schematic perspective view of a reading unit.
Figure 4:
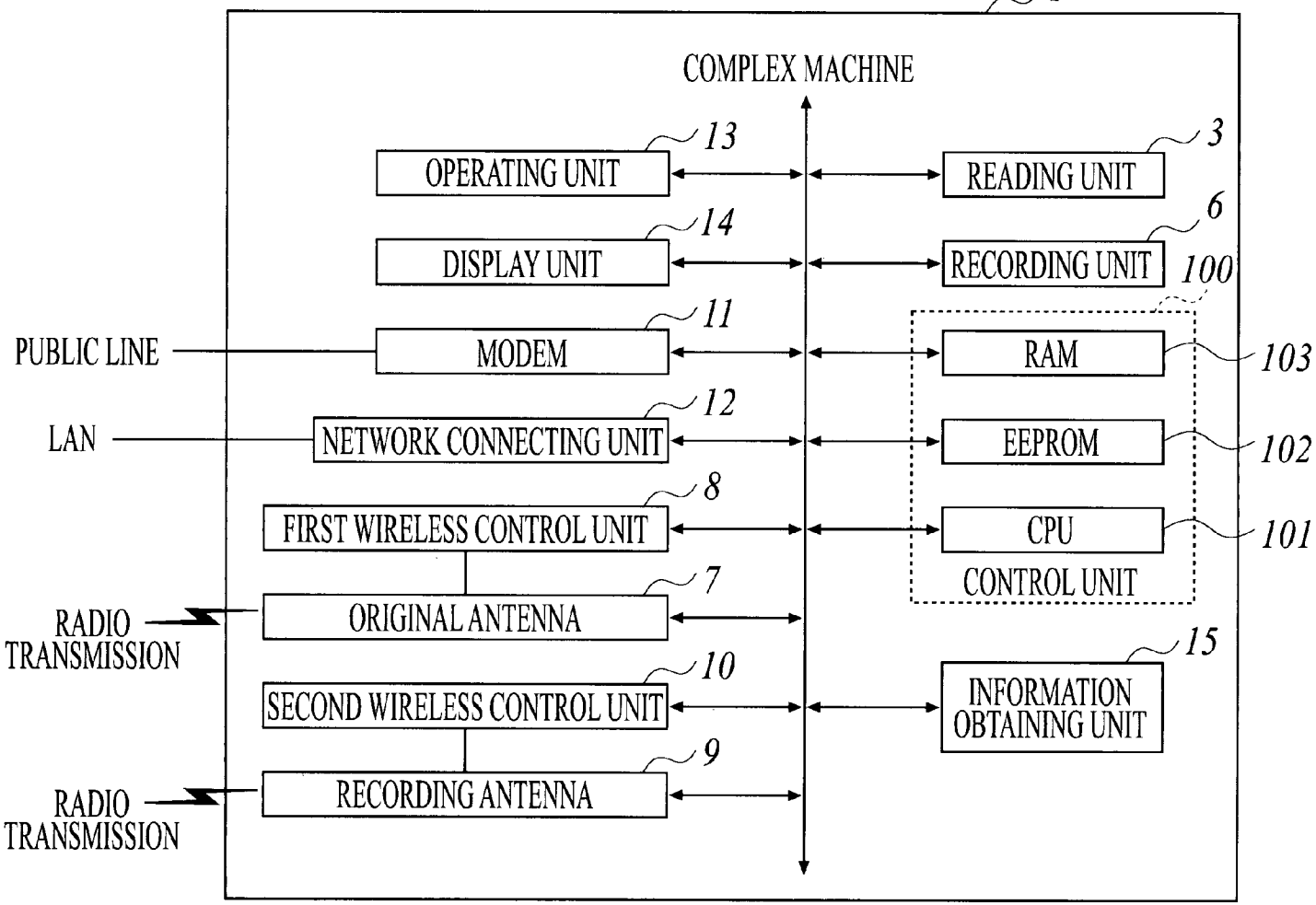
FIG. 4 is a schematic configuration block diagram of a complex machine.

As shown in FIG. 2, a scan head 3*a* is provided with an original antenna 7 for receiving information of a wireless IC tag 2*a* as a information chip, which is provided on the original 2. The original antenna 7 is movable on the scan head 3*a* in the width direction of the device main body. Consequently, paper information 2*b* stored in the wireless IC tag 2*a* of the original paper 2 can be received at the complex machine 1 side in the noncontact condition. As shown in FIG. 4, the paper information 2*b* is transferred to a control unit 100 through a first wireless control unit 8.

Figure 3:
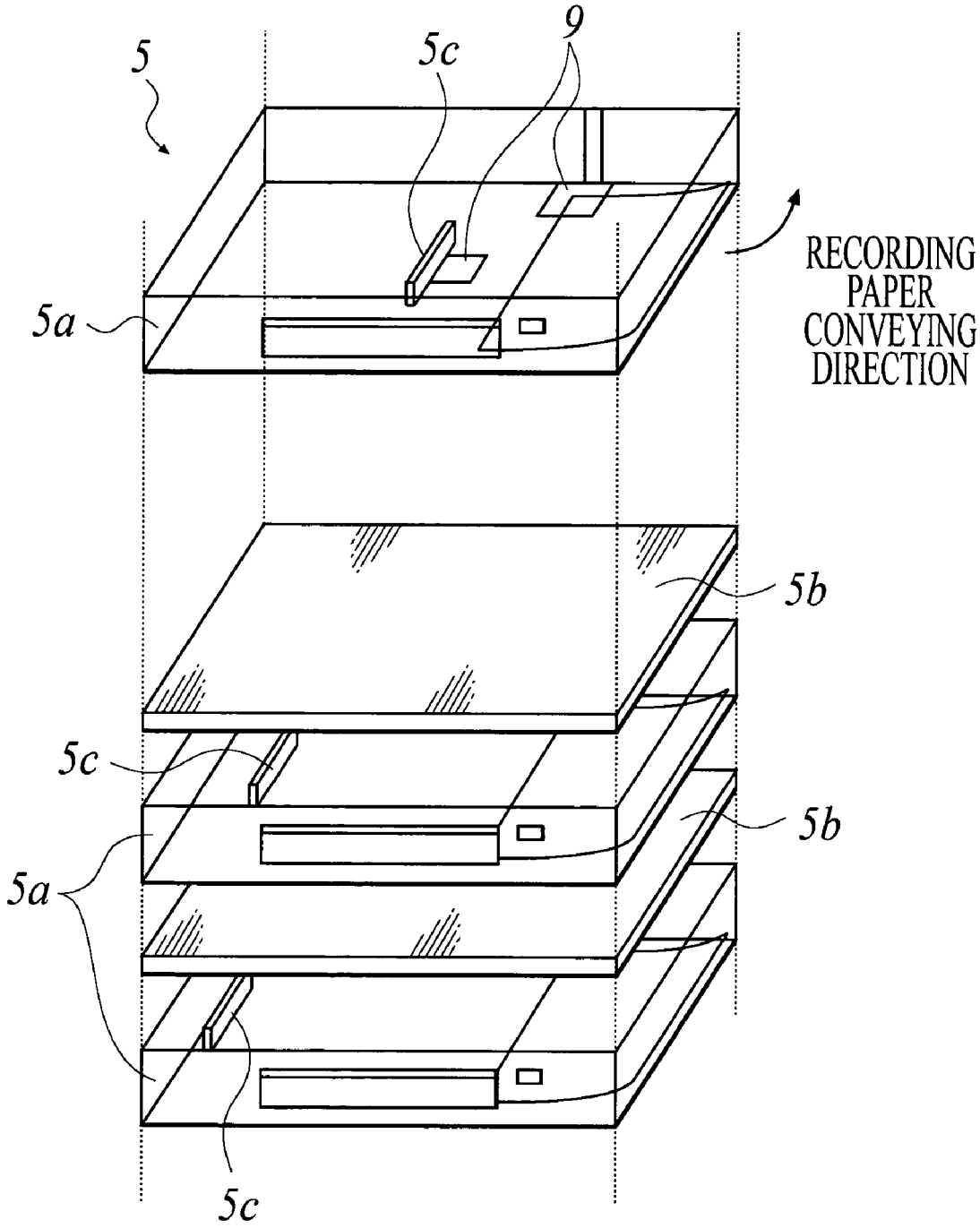
FIG. 3 is a schematic perspective view of a paper storage.

As shown in FIG. 3, the trays 5*a* in the paper storage 5 are divided off each other by shield plates 5*b* as shielding members for shielding electric waves. Incidentally, each of the trays 5*a* is provided with a dividing plate 5*c* which is movable according to the size of the recording paper 4. Between each of the shield plates 5*b*, a recording antenna 9 as a recording information receiving unit for receiving the information of a wireless IC tag 4*a* of the recording paper 4 is provided. Consequently, paper information 4*b* stored in the wireless IC tag 4*a* of the recording paper 4 can be received at the complex machine 1 side in the noncontact condition. As shown in FIG. 4, the paper information 4*b* received by the recording antenna 9 is transferred to a control unit 100 through a second wireless control unit 10.

Incidentally, the recording antenna 9 is thin enough for storing the recording paper 4 in each tray 5*a*. The place where the recording antenna 9 is placed can be provided anywhere as long as the information of the wireless IC tag 4*a* on the recording paper 4 can be received well. By integrating the recording antenna 9 with the dividing plate 5*c*, the recording antenna 9 may be movable along with the dividing plate 5*c*.

As shown in FIG. 4, the complex machine 1 is connected to a public line, a LAN line and the like, through a modem 11, a network connecting unit 12 and the like, respectively. That is, an image data sent from an external terminal or the like can be recorded on the recording paper 4 by the recording unit 6. As shown in FIG. 2, the complex machine 1 comprises an operating unit 13 and a display unit 14. That is, a user can input instructions for the operation by using the operating unit 13, or confirm operating condition of the complex machine 1 by using the display unit 14. Further, the complex machine 1 comprises an information obtaining unit 15 for obtaining the information related to the recording paper 4 in the state that the recording paper 4 is stored, by using the dividing plate 5*c* in the paper storage 5. Furthermore, when the information related to the recording paper 4 is obtained, the prior information can be selected alternatively between the paper information obtained by the information obtaining unit 15 and the paper information received by the recording antenna 9, by the operating unit 13.

As shown in FIG. 5A, the EEPROM 102 stores a normal copy program 104 for recording the image of the original paper 2 onto the recording paper 4. In the present embodiment, the normal copy program 104 is the program comprising the operation for selecting the recording paper 4 to be used for the image recording according to the paper information 2*b* received by the original antenna 7 and the paper information 4*b* received by the recording antenna 9. The paper information 4*b* received by the recording antenna 9 is stored in the EEFROM 102. When the paper information 4*b* is not received by the recording antenna 9, the information related to the recording paper 4, which is obtained by the information obtaining unit 15, is stored instead of the paper information 4*b*. Further, the normal copy program 104 also includes an operation for displaying that the information of the recording paper 4 is not received, on the display unit, when the paper information 4*b* is not received by the recording antenna 9.

As shown in FIG. 5A, the EEPROM 102 stores a normal copy program 104 for recording the image of the original paper 2 onto the recording paper 4. In the present embodiment, the normal copy program 104 is the program comprising the operation for selecting the recording paper 4 to be used for the image recording according to the paper information 2*b* received by the original antenna 7 and the paper information 4*b* received by the recording antenna 9. The paper information 4*b* received by the recording antenna 9 is stored in the EEPROM 102. When the paper information 4*b* is not received by the recording antenna 9, the information related to the recording paper 4, which is obtained by the information obtaining unit 15, is stored instead of the paper information 4*b*. Further, the normal copy program 104 also includes an operation for displaying that the information of the recording paper 4 is not received, on the display unit, when the paper information 4*b* is not received by the recording antenna 9.

Further, the EEPROM 102 stores a copy inhibiting information 105 related to the paper inhibited from the copying. In the present embodiment, the copy inhibiting information 105 comprises the information related to bills or marketable securities (such as stock certificates or government bonds).

Further, the EEPROM 102 stores an inhibition judging program 106 for judging whether or not the original paper 2 is the paper inhibited from the copying.

Furthermore, the EEPROM 102 stores a copy inhibiting program 107 for inhibiting the image recording performed by the recording unit 6, and a copy recording program 108 for controlling the recording unit 6 so that a predetermined image is recorded, being superposed on the image of the original, when the inhibition judging program 106 judges that the original paper 2 is the paper inhibited from the copying. The watermark is letter or the like such as "COPY", and is selected by a user as needed.

In the present embodiment, the copy inhibiting mode operated by the copy inhibiting program 107 and the copy recording mode operated by the copy recording program 108 can be alternatively selected by the operating unit 13.

Further, the EEPROM 102 stores follow-up information 109, a follow-up information storing program 110 and a database 111, the follow-up information storing program 110 is the program for storing the follow-up information 109 of the original paper 2 in the EEPROM 102 when the image recording by the recording unit 6 is performed. As shown in FIG. 5B, the follow-up information 109 comprises image data 109*a* of the original paper 2 and paper information 2*b* of the original paper 2. In the present embodiment, the follow-up information 109 further comprises user ID/name information 109*b*, the number of recording paper information 109*c*, recording stat time information 109*d* and recording mode information 109*e*. The database 111 stores the original type and the code of the original type (refer to FIG. 7)

Figure 6:
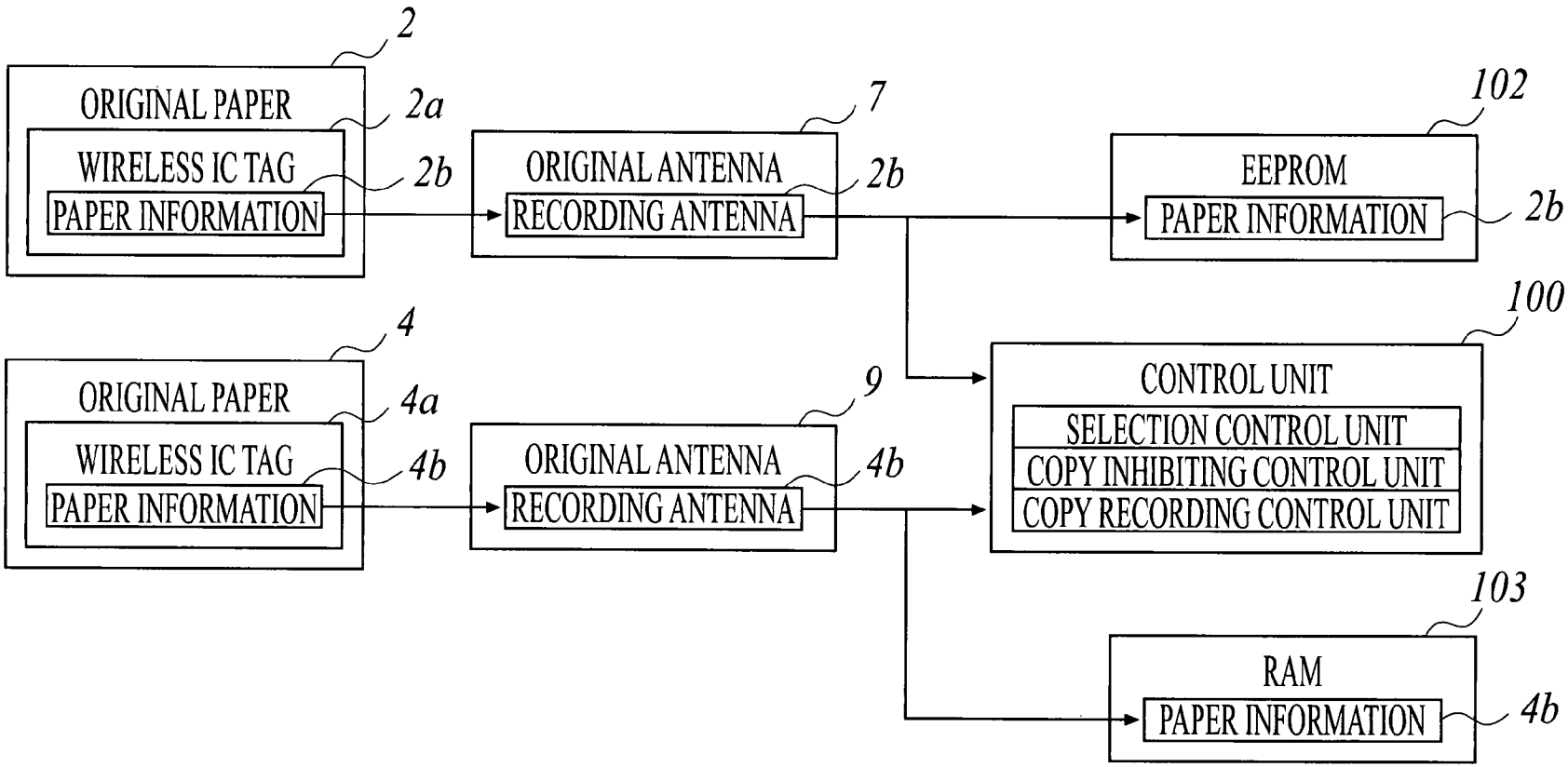
FIG. 6 is a pattern diagram showing communication channel of paper information of original paper and recording paper.
Figure 7:
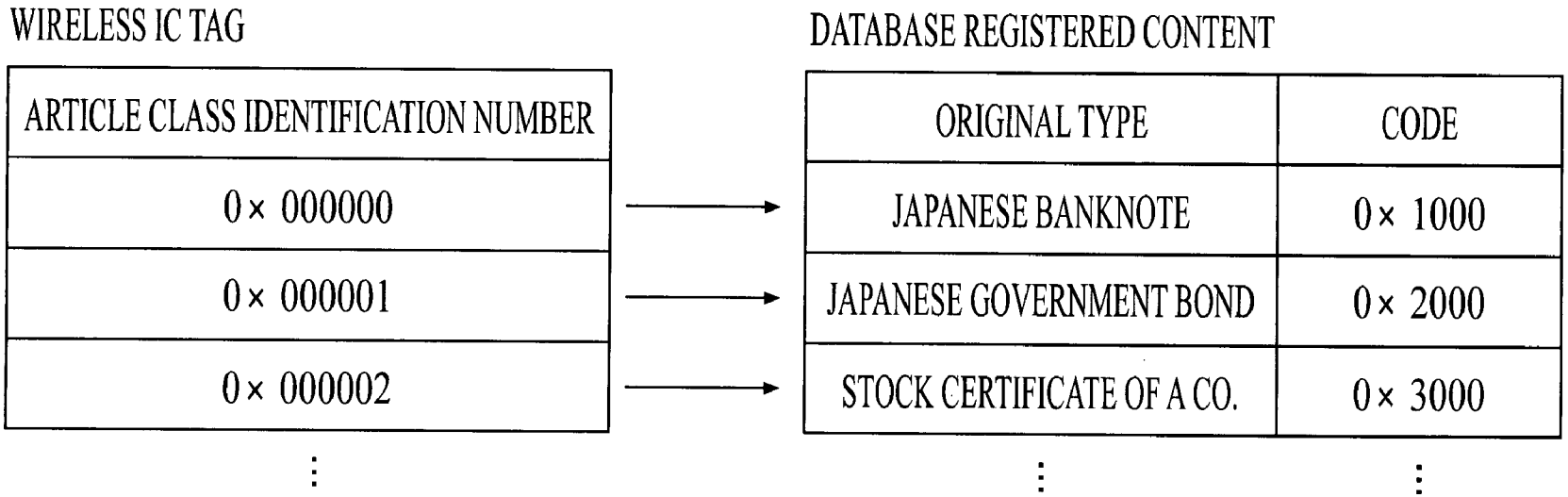
FIG. 7 is a diagram showing an example of correspondence of stored contents in a wireless IC tag to stored contents in a database.

In the complex machine 1 configured as above, as shown in FIG. 6, the paper information 2*b* of the original paper is received by the original antenna 7, and the paper information 4*b* of the recording paper 4 is received by the recording antenna 9, respectively. Then, the paper information 2*b* is transmitted to the control unit 100 through the wireless control units 8, and the paper information 4*b* is transmitted to the control unit 100 through the wireless control units 10, respectively. In the present embodiment, as shown in FIG. 7, an article class identification number is stored as the paper information 2*b* in the wireless IC tag 2*a*. In the control unit 100, the analysis of the original type corresponding to the article class identification number brought in the control unit 100 through each of the wireless control units 8 and 10, is performed by referring to the database 111. Then, based on the result of the analysis and the paper information 2*b* and 4*b*, the recording paper on which an image is to be recorded is selected. Further, in the present embodiment, as shown in FIG. 5C, the paper information 2*b* and 4*b* comprise the type, the size, the color and the like of paper. Furthermore, in the present embodiment, as shown in FIG. 6, the paper information 2*b* of the original paper 2 may be stored in the EEPROM 102 as the follow-up information 109.

The operation of the control unit 100 in the complex machine 1 configured as above will be described with reference to the flow charts shown in FIG. 8 and FIG. 9. In the present embodiment, by operating the operating unit 13 by a user, the condition of the operation of the control unit 100 can be switched between normal operation condition which limits the copying when the original paper 2 is of the paper inhibited from the copying and user authentication operation condition which makes the EEPROM 102 store the follow-up information 109 of the original paper 2 after performing user authentication process. Each condition will be described respectively.

Figure 8:
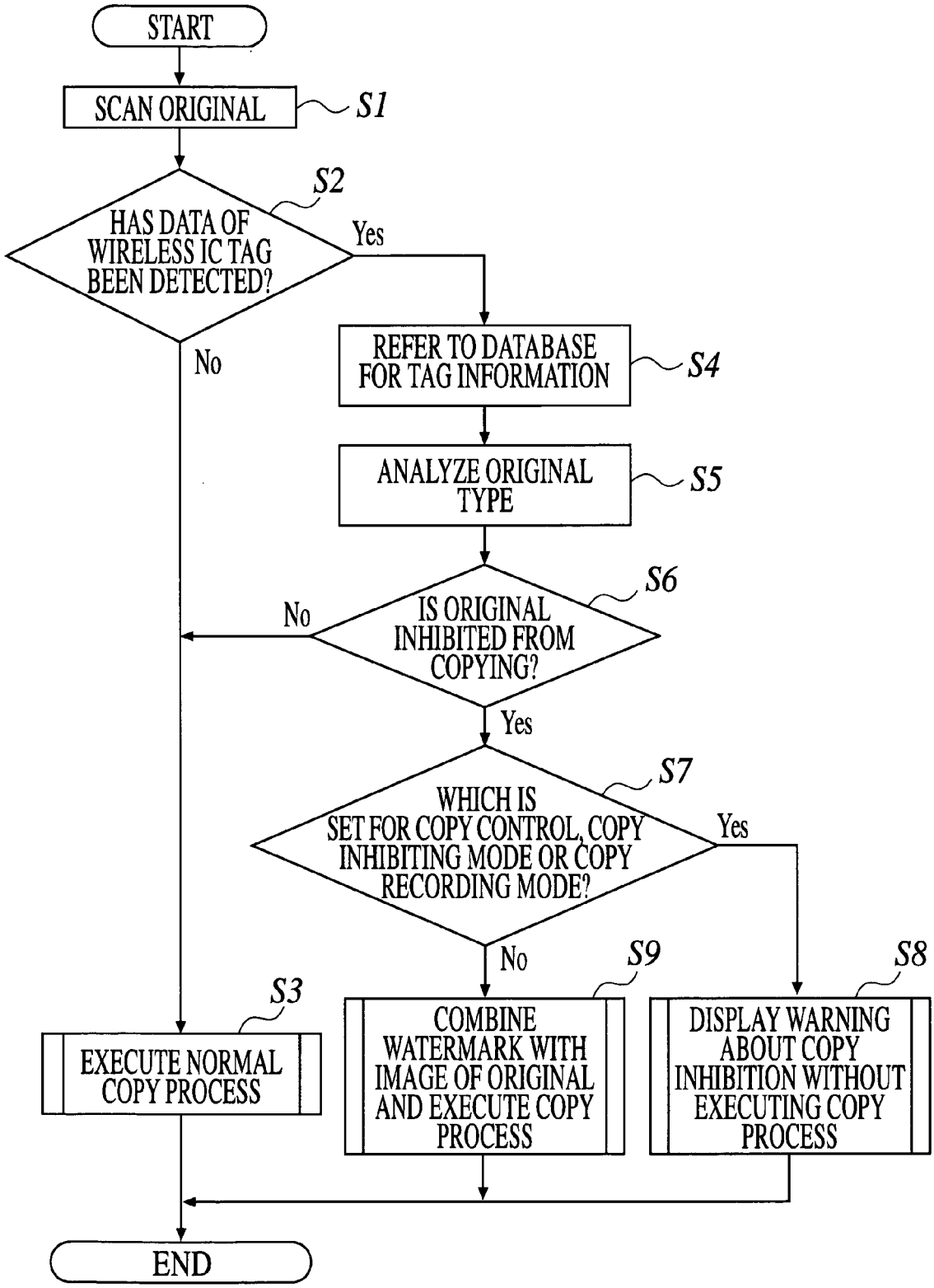
FIG. 8 is a flow chart showing an operation of a control unit.

In the case of the normal operation condition shown in FIG. 8, the image of the original paper 2 is read by the reading unit 3 (Step S1). Then, it is judged whether or not the data of the wireless IC tag 2*a* of the original paper 2 has been detected by the original antenna 7 (Step 2). In the case that the data of the wireless IC tag has not been detected, the normal copy process for copying the image of the original paper 2 is executed by the recording unit 6 (Step S3). Then, the copy control is terminated.

In the case that the data of the wireless IC tag 2*a* has been detected in Step 2, the control unit 100 refers to the database 111 for the information of the tag including the paper information 2*b* (Step S4). Then, the condition where the paper information 2*b* can be identified is provided. As above, by referring the database 111 for the article class identification number, the control unit 100 can analyze the original type corresponding to the article class identification number (Step S5).

Incidentally, the term "article class identification number" denotes 24-bit number representing the class of an article provided with the tag among Electronic Product Codes (EPC) stored in the wireless IC tag 2*a*. Hereinafter, in the present embodiment, a method of analyzing the paper information 2*b* by referring to the database 111 for the article class identification number will be described as an example.

Next, it is judged whether or not the original paper 2 is of the paper inhibited from the copying (Step S6). In the case that the original paper 2 is not of the paper inhibited from the copying, the process proceeds to Step 3, and the normal copy process is executed. In the case that the original paper 2 is of the paper inhibited from the copying, subsequently, the mode set for a copy control is judged between the copy inhibiting mode and the copy recording mode (Step S7).

When it is judged that the copy inhibiting mode is set in Step 7, the warning about copy inhibition is displayed on the display unit 14 without execution of the image recording process by the recording unit 6 (Step S8). Then the control is terminated. Further, when it is judged that the copy recording mode is set in Step S7, a watermark is recorded on the recording paper 4 along with the image of the original (Step S9). Then, the control is terminated.

Figure 9:
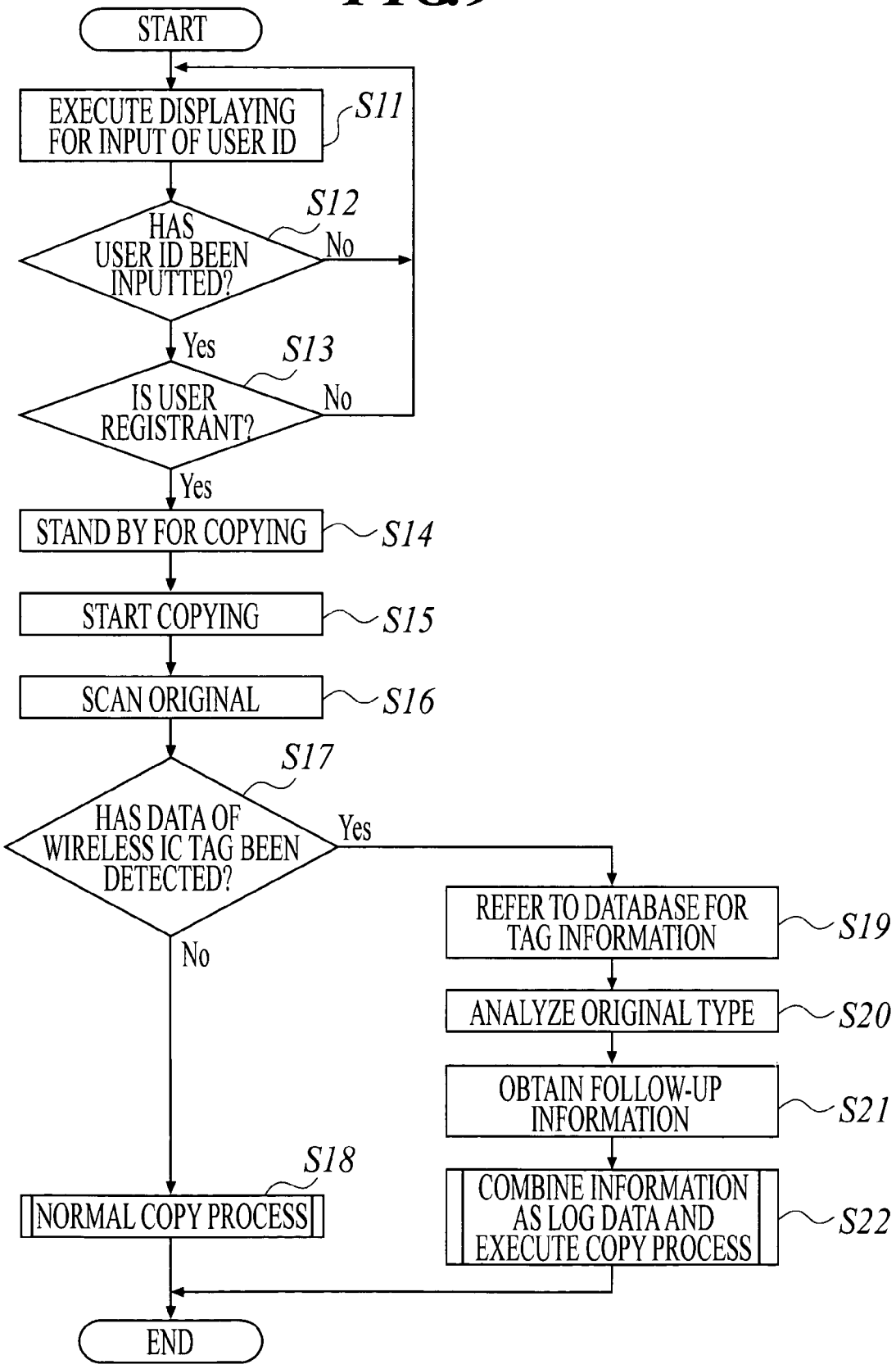
FIG. 9 is a flow chart showing an operation of a control unit.

Further, in the case of an user identifying operation condition shown in FIG. 9, the displaying for input of the user ID is executed on the display unit 14 (Step S11), and it is judged whether or not the ID has been inputted from the operating unit 13 by a user (Step S12). In the case that the ID has not been inputted, the process returns to Step S11, and a standby state is provided. In the case that the ID has been inputted in Step S12, subsequently, it is judged whether or not the user is the registrant (Step S13).

When it is judged that the user is not the registrant in Step S13, the process returns to Step S13, and a standby state is provided. When it is judged that the user is the registrant, the process proceeds to the standby state for the copy control (Step S14). Then, when the copying operation is started after the original or the number of copies has been set by the user (Step S15), the image of the original paper 2 is read by the reading unit 3 (Step S16).

Then, it is judged whether or not the data of the wireless IC tag 2*a* of the original paper 2 has been detected by the original antenna 7 (Step S17). In the case that the data of the wireless IC tag 2*a* has not been detected, the normal copy process for copying the image of the original 2 is executed by the recording unit 6 (Step S18). Then, the copy control is terminated.

In the case that the data of the wireless IC tag 2*a* has been detected in Step 2, the control unit 100 refers to the database 111 for the information of the tag including the paper information 2*b* (Step S19). Then, the condition where the paper information 2*b* can be identified is provided. Also in this case, as shown in FIG. 7, the article class identification number is stored as the paper information 2*b* in the wireless IC tag 2*a*. By referring the database 111 for the article class identification number, the control unit 100 can analyze the original type corresponding to the article class identification number (Step S20).

Then, an image data 109*a*, user ID/name information 109*b*, the number of the recording information 109*c*, recording start time information 109*d*, recording mode information 109*e* and the like are generated so that the EEPROM 102 stores the follow-up information 109 (Step S21). Then, such information 2*b*, 109*a*, 109*b*, 109*c*, 109*d* and 109*e* are combined each other as the log data, and stored in the RRPEOM 102, and the copying of the image is executed (Step S22). Further, each of the information 2*b*, 109*a*, 109*b*, 109*c*, 109*d* and 109*e* is outputted to the recording paper along with the image of the original. After that, the control is terminated.

As above, according to the complex machine 1 in the present embodiment, the paper information 2*b* of the original paper 2 is received by the original antenna 7 when the image of the original is read by the reading unit 3. Then, the recording paper 4 to be used for the image recording is automatically selected by the control unit 100. Consequently, based on the precise information, the proper recording paper 4 corresponding to the image of the original is selected, and accordingly, the image recording can be performed appropriately. Therefore, even if an recording paper 4 unsuitable for the recording of the image of the original is set by the operating unit 13 or the like, the image can be recorded on the recording paper of another type on which the image can be recorded.

Particularly, in the present embodiment, the recording paper 4 to be used for the image recording is selected by using the paper information 4*b* of the recording paper 4 in addition to the paper information 2*b* of the original paper 2. Therefore, based on more pieces of information, the proper recording paper 4 corresponding to the image of the original is selected, and accordingly, the image recording can be performed more appropriately.

Further, according to the complex machine 1 in the present embodiment, a user can select and operate alternatively between the copy inhibiting mode and the copy recording mode by operating the operating unit 13. Then, in the copy inhibiting mode, when the type of the original paper 2 in the reading unit 3 corresponds to the type of the copy inhibiting information 105 stored in the EEPROM 102, the image recording is inhibited. Further, in the copy recording mode, when the type of the original paper 2 in the reading unit 3 corresponds to the type of the copy inhibiting information 105 stored in the EEPROM 102, a predetermined image is recorded, being superposed on the image of the original. Consequently, it can be inhibited to copy the paper inhibited from copying by the law or the like, or the paper related to trade secrets. Further, it can be prevented to copy such paper entirely. Therefore, unauthorized reproduction, illegal forgery, breach of confidence, or the like can be obviated. Then, the extreme advantage for the practical use can be provided. In particular, in the present embodiment, the copy inhibiting information 105 includes the information related to banknotes or marketable securities. Therefore, by limiting the copying of banknotes or marketable securities, the forgery by such copying can be prevented.

Further, according to the complex machine 1 in the present embodiment, when the image of the original is recorded on the recording paper 4, the follow-up information 109 is stored in the EEPROM 102. Consequently, a user can search the intended image data 109*a*, intended paper information 2*b* or the like from the follow-up information 109 stored in the EEPROM 102. That is, if later, a user loses an original or the like, of which copying was performed, or a user needs to obtain a copied recording object at once, the user can obtain the data of the intended recording object by searching the follow-up information 109, or can obtain the follow-up information 109 with respect to an attempt on illegal copying. Particularly, according to the present embodiment, the follow-up information 109 stored in the EEPROM 102 is outputted to the recording paper 4. Therefore, a user can recognize the follow-up information 109 being stored in the EEPROM 102.

Further, according to the complex machine 1 in the present embodiment, the scan head 3*a* which moves along the original paper 2 so as to scan whole image of the original paper 2 is provided with the original antenna 7. Therefore, no matter where on the original paper 2 the wireless IC tag 2*a* is provided, the paper information 2*b* can be received certainly.

Further, according to the complex machine 1 in the present embodiment, the paper information 4*b* received by the recording antenna 9 is stored in the EEPROM 102. Therefore, the control unit 100 can select the recording paper 4 by using the paper information 4*b* stored in the EEPROM 102. Consequently, it is not necessary that the paper information 4*b* of the recording paper 4 is recognized in real time. Further, also in the case that there is limitation that the reading of the paper information 4*b* from the wireless IC tag 2*a* can not be always performed because of the characteristics of the communication with the wireless IC tag 2*a* as an information chip, the proper recording paper 4 can be selected based on recorded contents. Further, because once is enough as the number of times of the recognition for the paper information 4*b*, the configuration or the like of the recording antenna 9 can be simplified.

Further, according to the complex machine 1 in the present embodiment, when the paper information 4*b* of the recording paper 4 is not received, the information, which is obtained in the state that the recording paper 4 is stored, is stored in the EEPROM 102 as the information of the recording paper 4. Consequently, even when the paper information 4*b* can not be received because of the communication condition or the like in spite of the storing of the recording paper 4 in the tray 5*a* of the paper storage 5, the information of the recording paper 4 is stored in the state that the recording paper 4 is stored. Therefore, the selection of the recording paper 4 can be performed.

Further, according to the complex machine 1 in the present embodiment, when the recording antenna 9 is not received the paper information 4*b*, it is displayed on the display unit 14 that the information of the recording paper 4 is not received. Therefore, with the display unit 14, a user can recognize that the paper information of the recording paper 4 is not received. Consequently, the user can perform procedures to obtain the paper information 4*b* by inputting the paper information 4*b* of the recording paper 4 directly from the operating unit 13 or the like of the device or by making the recording antenna 9 receive the paper information 4*b* of the recording paper 4 again.

Further, according to the complex machine 1 in the present embodiment, when the selection of the recording paper 4 is performed, a user can operate the selection of the prior information between the paper information of the recording paper 4 obtained in the condition that the recording paper 4 is stored and the paper information of the recording paper 4 received by the recording antenna 9, by operating the operating unit 13. Therefore, for example, in the case that A4-sized recording paper 4, in which the wireless IC tag 2*a* as the information chip is implanted and which is provided by cutting A3-sized recording paper 4 half artificially, is used, the recording paper can be selected precisely without mis-selecting the size thereof, by giving preference to the recording paper information obtained in the state that the recording paper is stored, over the information in the wireless IC tag 2*a* obtained from the recording antenna 9.

Further, according to the complex machine 1 in the present embodiment, the shield plates 5*b* are placed between each of the trays 5*a* in the paper storage 5. Therefore, there is no possibility that the electric waves from the wireless IC tags on the recording paper 4 of the different types are received by the recording antenna 9 in the state that the electric waves are crossing each other, even when each of the recording paper 4 of different types is respectively stored in each of the trays 5*a*. Therefore, the reliability of the device can be improved without disturbing of the control caused by the mis-receiving of the paper information of the recording paper 4 of another type.

Incidentally, in the above embodiment, the complex machine 1 comprising functions of a copier (including a scanner), a printer and a facsimile or the like is exemplified. However, also a simple complex machine can provide advantages same as those of the above embodiment. Further, when the printing on the recording paper 4 is performed in the case of the printer, and when an original is scanned in the case of the facsimile, the advantages same as those of the above embodiment can be obtained respectively.

Further, in the above embodiment, as shown in FIG. 8 and FIG. 9, the device capable of switching the condition between the normal operation condition for performing the inhibition and the limitation of the copying and the user identifying operation condition for performing the storing of the follow-up information 109, has been described. However, of course, the device can be configured so as to perform the inhibition and the limitation of the copying, and further, perform the storing of the follow-up information 109.

Further, in the above embodiment, the device, which is configured so as to select the copy inhibiting mode and the copy recording mode alternatively, has been described. However, the device can be configured so as to perform only any one of the modes.

Further, in the present embodiment, the device, which is configured so as to be provided with the original antenna 7 and the recording antenna 9 and receive the data sent from both of the wireless tag 2*a* of the original paper 2 and the wireless tag 4*a* of the recording paper 4, has been described. However, the device can be configured so as to receive the data from any one of the original paper 2 and the recording paper 4.

Further, in the above embodiment, the device, which is configured so as to analyze the paper based on the article class identification number as the paper information 2*b* and 4*b* from the wireless tags 2*a* and 4*a*, has been described. However, the analysis of the paper can be performed by using another number information such as an article identifying number.

Further, in the present embodiment, the device, which is configured so as to store the follow-up information 109 in the electrically rewritable EEPROM 102. However, the device can be configured so as to store the follow-up information 109 in the RAM 101 and use the electrically un-rewritable ROM. Furthermore, of course in addition to the above, the concrete detail configuration or the like can be also changed as needed.

The entire disclosure of Japanese Patent Application No. Tokugan 2003-198011 filed on Jul. 16, 2003 including specification, claims, drawings and summary are incorporated herein by reference in its entirety.

What is claimed is:

1. An image recording device comprising:

a reading unit for reading an image on an original paper;

a paper storage for storing recording pacer of a plurality of types;

a recording unit for recording the image read by the reading unit on the recording paper selected from the paper storage;

an original information receiving unit for receiving paper information from an information chip which is provided on the original paper and on which the paper information is stored; and a selection control unit for selecting the recording paper to be used for recording the image based on the paper information received by the original information receiving unit, wherein copy inhibiting information related to paper inhibited from copying is previously stored in a storage, and wherein the image recording by the recording unit is inhibited, when the original paper is determined to be paper inhibited from the copying, as a result of a comparison between the paper information received by the original information receiving unit and the copy inhibiting information stored in the storage.

2. The image recording device of claim 1, wherein the copy inhibiting information comprises information related to at least one of a bank note and marketable securities.

3. The image recording device of claim 1, wherein the storage is provided in the image recording device.

4. The image recording device of claim 1, wherein the paper information of the original is obtained by scanning all of the original paper.

5. The image recording device of claim 4, wherein the original information receiving unit is provided in a scan head which is provided in the reading unit and moves along the original paper when the original is read.

6. An image recording device comprising:

a reading unit for reading an image on an original paper;

a paper storage for storing recording paper of a plurality of types;

a recording unit for recording the image read by the reading unit on the recording paper selected from the paper storage;

an original information receiving unit for receiving paper information from an information chip which is provided on the original paper and on which the paper information is stored; and a selection control unit for selecting the recording paper to be used for recording the image based on the paper information received by the original information receiving unit, wherein copy inhibiting information related to paper inhibited from copying is previously stored in a storage, and wherein a predetermined image is recorded to be superposed on the image read by the reading unit, when the original paper is determined to be paper inhibited from the copying, as a result of a comparison between the paper information received by the original information receiving unit and the copy inhibiting information stored in the storage.

7. The image recording device of claim 6, wherein the copy inhibiting information comprises information related to at least one of a bank note and marketable securities.

8. The image recording device of claim 6, wherein the storage is provided in the image recording device.

9. The image recording device of claim 6, wherein the paper information of the original is obtained by scanning all of the original paper.

10. The image recording device of claim 9, wherein the original information receiving unit is provided in a scan head which is provided in the reading unit and moves along the original paper when the original is read.

11. The image recording device of claim 6, wherein the predetermined image is a watermark.

12. An image recording device comprising:

a reading unit for reading an image on an original paper;

a paper storage for storing recording paper of a plurality of types;

a recording unit for recording the image read by the reading unit on the recording paper selected from the paper storage;

an original information receiving unit for receiving paper information from an information chip which is provided on the original paper and on which the paper information is stored; and a selection control unit for selecting the recording paper to be used for recording the image based on the paper information received by the original information receiving unit;

wherein copy inhibiting information related to paper inhibited from copying is previously stored in a storage, and wherein the image recording device further comprises an operating unit adapted to selectively set one of a copy inhibiting mode for inhibiting the image recording by the recording unit and a copy recording mode for controlling the recording unit so that a predetermined image is recorded to be superposed on the image read by the reading unit, when the original paper is determined to be paper inhibited from the copying, as a result of a comparison between the paper information received by the original information receiving unit and the copy inhibiting information stored in the storage.

13. The image recording device of claim 12, wherein the copy inhibiting information comprises information related to at least one of a bank note and marketable securities.

14. The image recording device of claim 12, wherein the storage is provided in the image recording device.

15. The image recording device of claim 12, wherein the paper information of the original is obtained by scanning all of the original paper.

16. The image recording device of claim 15, wherein the original information receiving unit is provided in a scan head which is provided in the reading unit and moves along the original paper when the original is read.

17. The image recording device of claim 12, wherein the predetermined image is a watermark.

18. An image recording device comprising:

a reading unit for reading an image on an original paper;

a paper storage for storing recording paper of a plurality of types;

a recording unit for recording the image read by the reading unit on the recording paper selected from the paper storage;

a recording information receiving unit for receiving paper information from an information chip which is provided on the recording paper and on which the paper information is stored;

an information obtaining unit for obtaining information related to the recording paper while the recording paper is stored; and a selection control unit for selecting the recording paper to be used for recording the image based on the paper information received by the recording information receiving unit, wherein the paper information received by the recording information receiving unit is stored in a storage, and wherein when the paper information is not received by the recording information receiving unit, the information obtained by the information obtaining unit that is related to the recording paper is stored in the storage.

19. The image recording device of claim 18, further comprising an operating unit adapted to select one of the information obtained by the information obtaining unit and the paper information obtained by the recording information receiving unit as prior information for selecting the recording paper to be used for the image recording.

20. The image recording device of claim 18, wherein when the paper information is not received by the recording information receiving unit, a display unit displays that the paper information of the recording paper has not been received.

21. The image recording device of claim 18, wherein the storage is provided in the image recording device.

22. The image recording device of claim 18, wherein the paper information of the original is obtained by scanning whole of the original paper.

23. The image recording device of claim 22, wherein the original information receiving unit is provided in a scan head which is provided in the reading unit and moves along the original paper when the original is read.

24. An image recording device comprising:

a reading unit for reading an image on an original paper;

a paper storage for storing recording paper of a plurality of types;

a recording unit for recording the image read by the reading unit on the recording paper selected from then paper storage;

an original information receiving unit for receiving paper information from an information chip which is provided on the original paper and on which the paper information is stored; and a selection control unit for selecting the recording paper to be used for recording the image based on the paper information received by the original information receiving unit, wherein shielding members for shielding an electric wave are placed between a plurality of trays in the paper storage.

25. The image recording device of claim 24, wherein the paper information of the original is obtained by scanning all of the original paper.

26. The image recording device of claim 25, wherein the original information receiving unit is provided in a scan head which is provided in the reading unit and moves along the original paper when the original is read.

27. An image recording device comprising:

a reading unit which reads an image on an original paper;

a paper storage which stores recording paper of a plurality of types;

a recording unit which records the image read by the reading unit on the recording paper selected from the paper storage; and an original information receiving unit which receives paper information from an information chip which is provided on the original paper and on which the paper information is stored, wherein copy inhibiting information related to paper inhibited from copying is previously stored in a storage, and wherein the image recording by the recording unit is inhibited, when the original paper is determined to be paper inhibited from the copying, as a result of a comparison between the paper information received by the original information receiving unit and the copy inhibiting information stored in the storage.

28. The image recording device of claim 27, wherein at least image data of the image on the original paper and the paper information of the original paper are stored in the storage as follow-up information, when the image recording is performed by the recording unit.

29. The image recording device of claim 28, wherein the follow-up information stored in the storage is outputted on the recording paper along with the image read by the reading unit when the image recording is performed by the recording unit.

30. The image recording device of claim 27, further comprising a recording information receiving unit for receiving paper information from an information chip which is provided on the recording paper and on which the paper information is stored, wherein the control unit selects the recording paper to be used for the image recording based on the paper information received by the original information receiving unit and the paper information received by the recording information receiving unit.

31. The image recording device of claim 30, wherein the paper information received by the recording information receiving unit is stored in the storage.

32. The image recording device of claim 31, further comprising an information obtaining unit for obtaining information related to the recording paper while the recording paper is stored, wherein when the paper information is not received by the recording information receiving unit, the information obtained by the information obtaining unit that is related to the recording paper is stored in the storage.

33. The image recording device of claim 32, further comprising an operating unit adapted to select one of the information obtained by the information obtaining unit and the paper information obtained by the recording information receiving unit as prior information for selecting the recording paper to be used for the image recording.

34. The image recording device of claim 31, wherein when the paper information is not received by the recording information receiving unit, a display unit display that the paper information of the recording paper has not been received.

35. The image recording device of claim 27, wherein the storage is provided in the image recording device.

36. The image recording device of claim 27, wherein the paper information is obtained by scanning all of the original paper.

37. The image recording device of claim 36, wherein the original information receiving unit is provided in a scan head which is provided in the reading unit and moves along the original paper when the original is read.

38. An image recording device comprising:

a reading unit which reads an image on an original paper;

a paper storage which stores recording paper of a plurality of types;

a recording unit which records the image read by the reading unit on the recording paper selected from the paper storage; and an original information receiving unit which receives paper information from an information chip which is provided on the original paper and on which the paper information is stored, wherein copy inhibiting information related to paper inhibited from copying is previously stored in a storage, and wherein a predetermined image is recorded to be superposed on the image read by the reading unit, when the original paper is determined to be paper inhibited from the copying, as a result of a comparison between the paper information received by the original information receiving unit and the copy inhibiting information stored in the storage.

39. The image recording device of claim 38, wherein at least image data of the image on the original paper and the paper information of the original paper are stored in the storage as follow-up information, when the image recording is performed by the recording unit.

40. The image recording device of claim 39, wherein the follow-up information stored in the storage is outputted on the recording paper along with the image read by the reading unit when the image recording is performed by the recording unit.

41. The image recording device of claim 38, further comprising a recording information receiving unit for receiving paper information from an information chip which is provided on the recording paper and on which the paper information is stored, wherein the control unit selects the recording paper to be used for the image recording based on the paper information received by the original information receiving unit and the paper information received by the recording information receiving unit.

42. The image recording device of claim 41, wherein the paper information received by the recording information receiving unit is stored in the storage.

43. The image recording device of claim 42, further comprising an information obtaining unit for obtaining information related to the recording paper while the recording paper is stored, wherein when the paper information is not received by the recording information receiving unit, the information obtained by the information obtaining unit that is related to the recording paper is stored in the storage.

44. The image recording device of claim 43, further comprising an operating unit adapted to select one of the information obtained by the information obtaining unit and the paper information obtained by the recording information receiving unit as prior information for selecting the recording paper to be used for the image recording.

45. The image recording device of claim 42, wherein when the paper information is not received by the recording information receiving unit, a display unit displays that the information of the recording paper has not been received.

46. The image recording device of claim 38, wherein the storage is provided in the image recording device.

47. The image recording device of claim 38, wherein the paper information of the original is obtained by scanning all of the original paper.

48. The image recording device of claim 47, wherein the original information receiving unit is provided in a scan head which is provided in the reading unit and moves along the original paper when the original is read.

49. The image recording device of claim 38, wherein the predetermined image is a watermark.

50. An image recording device comprising;

a reading unit which reads an image on an original paper;

a paper storage which stores recording paper of a plurality of types;

a recording unit which records the image read by the reading unit on the recording paper selected from the paper storage; and an original information receiving unit which receives paper information from an information chip which is provided on the original paper and on which the paper information is stored, wherein copy inhibiting information related to paper inhibited from copying is previously stored in a storage, and wherein the image recording device further comprises an operating unit adapted to selectively set one of a copy inhibiting mode for inhibiting the image recording by the recording unit and a copy recording mode for controlling the recording unit so that a predetermined image is recorded to be superposed on the image read by the reading unit, when the original paper is determined to be paper inhibited from the copying, as a result of a comparison between the paper information received by the original information receiving unit and the copy inhibiting information stored in the storage.

51. The image recording device of claim 50, wherein at least image data of the image on the original paper and the paper information of the original paper are stored in the storage as follow-up information, when the image recording is performed by the recording unit.

52. The image recording device of claim 51, wherein the follow-up information stored in the storage is outputted on the recording paper along with the image read by the reading unit when the image recording is performed by the recording unit.

53. The image recording device of claim 50, further comprising a recording information receiving unit for receiving paper information from an information chip which is provided on the recording paper and on which the paper information is stored, wherein the control unit selects the recording paper to be used for the image recording based on the paper information received by the original information receiving unit and the paper information received by the recording information receiving unit.

54. The image recording device of claim 53, wherein the paper information received by the recording information receiving unit is stored in the storage.

55. The image recording device of claim 54, further comprising an information obtaining unit for obtaining information related to the recording paper while the recording paper is stored, wherein when the paper information is not received by the recording information receiving unit, the information obtained by the information obtaining unit that is related to the recording paper is stored in the storage.

56. The image recording device of claim 55, further comprising an operating unit adapted to select one of the information obtained by the information obtaining unit and the paper information obtained by the recording information receiving unit as prior information for selecting the recording paper to be used for the image recording.

57. The image recording device of claim 54, wherein when the paper information is not received by the recording information receiving unit, a display unit displays that the information of the recording paper has not been received.

58. The image recording device of claim 50, wherein the storage is provided in the image recording device.

59. The image recording device of claim 50, wherein the paper information of the original is obtained by scanning all of the original paper.

60. The image recording device of claim 59, wherein the original information receiving unit is provided in a scan head which is provided in the reading unit and moves along the original paper when the original is read.

61. The image recording device of claim 50, wherein the predetermined image is a watermark.

* * * * *